US006053630A

United States Patent [19]

Polansky et al.

[11] Patent Number: 6,053,630

[45] Date of Patent: Apr. 25, 2000

[54] ADJUSTABLE BAND

[75] Inventors: Edwin H. Polansky, 2 Hennion Dr., Parsippany, N.J. 07054; Robert H. Arndt, 1030 Montauk Dr., Forked River, N.J. 08731

[73] Assignees: Edwin H. Polansky, Parsippany; Robert H. Arndt, Forked, both of N.J.; Lisa B. Popowich, Philadelphia, Pa.

[21] Appl. No.: 08/998,379

[22] Filed: Dec. 24, 1997

[51] Int. Cl.[7] ..... G04B 37/00; A44C 5/00

[52] U.S. Cl. ..... 368/281; 224/175; 24/265 WS

[58] Field of Search ..... 368/281; 224/168–180; 24/265 WS

[56] References Cited

U.S. PATENT DOCUMENTS

| | | |
|---|---|---|
| 2,871,655 | 2/1959 | O'Larte et al. . |
| 3,237,395 | 3/1966 | Bennett . |
| 3,416,305 | 12/1968 | Rieth . |
| 4,096,688 | 6/1978 | Rieth . |

*Primary Examiner*—Bernard Roskoski

*Attorney, Agent, or Firm*—Kirschstein, et al.

[57] ABSTRACT

An elongated annular element to be worn around a user's wrist includes an expandable band including a multitude of expansion links situated adjacent one another longitudinally of the band and resiliently movable apart. Two such expansion links are separated from one another to form a gap, and an extension arrangement is interposed between them to span such gap. The extension arrangement includes a plurality of extension links situated next to one another. Any desired number of the extension links, as well as the connecting expansion links, are connected to one another to give the extension arrangement the length desired for extending the annular element. Each of the links to be connected includes at least one of the following two counterpart formations: a pair of lugs spaced from one another transversely of the annular element and each provided with a through aperture therein, and a sleeve-shaped portion bounding an elongated passage. A resiliently telescopically expandable and retractable elongated connecting pin having a main body received in respective one of the passages, and two end portions each received in one of the apertures of the associated ones of the lugs achieves the desired connection.

3 Claims, 1 Drawing Sheet

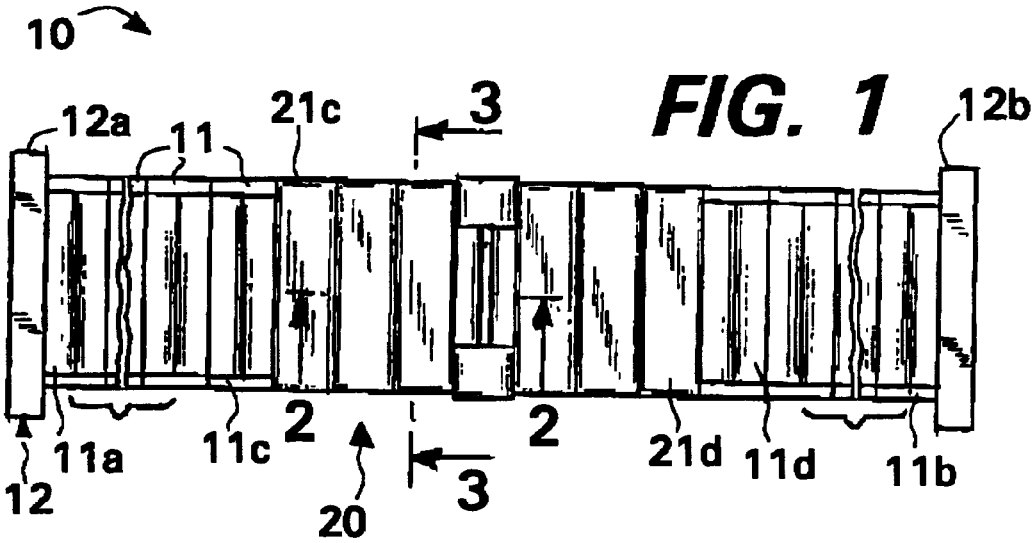
FIG. 1
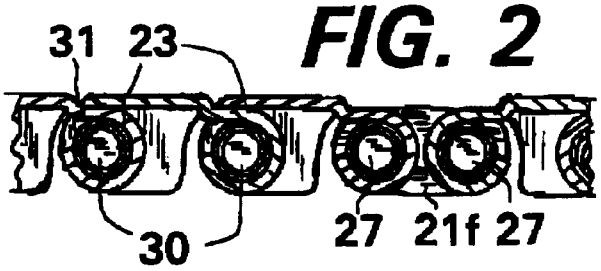
FIG. 2
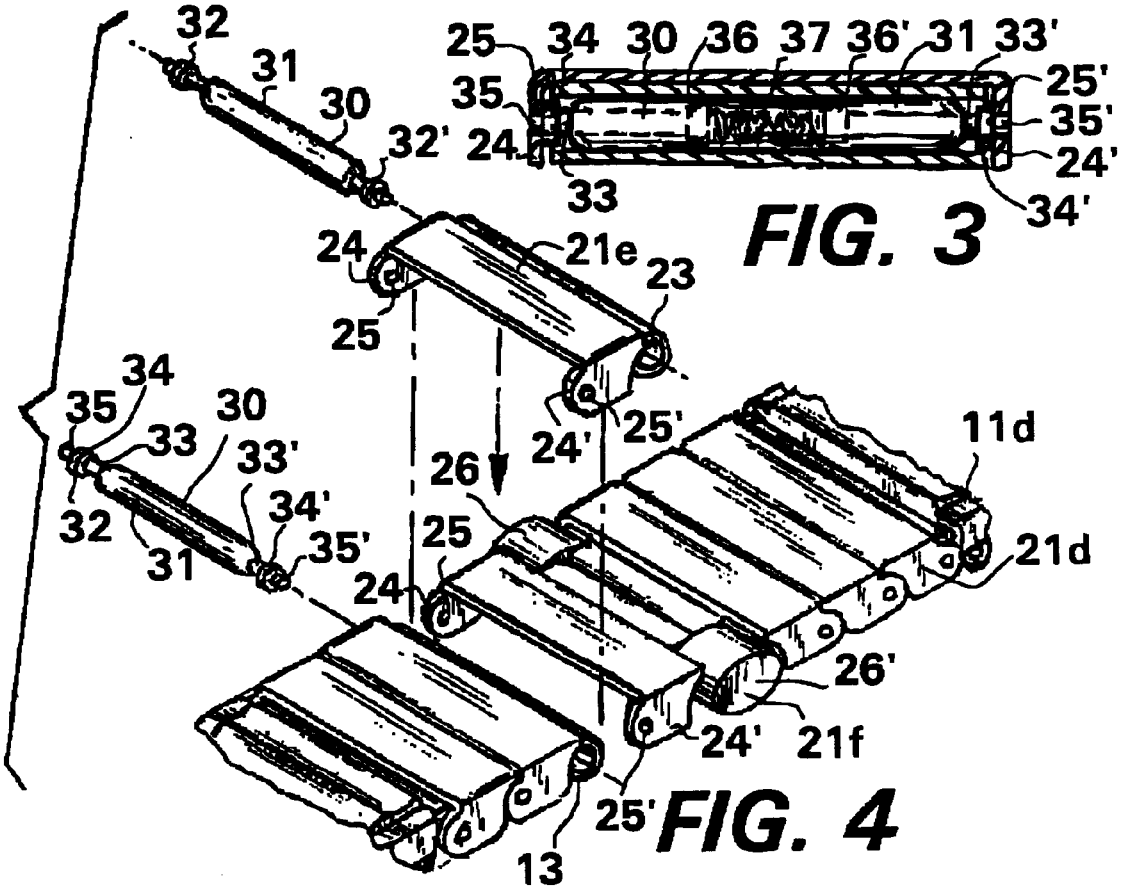
FIG. 3
FIG. 4

ADJUSTABLE BAND

BACKGROUND OF THE INVENTION

1. Field of the Invention

The present invention relates to expandable bands in general, and more particularly to adjustable watchbands or similar articles forming or incorporated in annular elements to be worn around parts of the bodies of their users.

2. Description of the Related Art

There are already known various constructions of watchbands and similar articles to be worn by their users, among them, traditionally, such that are provided with clasps, buckles or similar connecting elements interposed between two portions of the respective band to provide for substantially snug, but releasable, mounting of the ultimately annular element constituted by or incorporating the band around the body part on which the element is to be worn. Many a watch or other utilitarian or adorning article of a similar kind has been lost or damaged, however, due to the accidental or inadvertent release of the clasp or buckle.

To avoid this, it has been proposed relatively recently, but still quite a while ago, to dispense with such clasps or buckles. To be able to do so, however, a way had to be found to get the now permanently annular element past a body portion, such as a hand, with a relatively larger circumference before reaching its final destination at a body portion (e.g., a wrist) with a relatively smaller circumference.

Moreover, in many instances (a wristwatch being just one of the examples), it was also required that the article or annular element not be loose when at its position of use. Both of these requirements have been met by so-called expandable bands consisting of individual links that can be displaced relative to one another when external forces tending to increase the length of the band are applied to the latter, in such a manner as to allow such a longitudinal expansion, but with a built-in resiliency that returns the band to its shortest permitted length upon discontinuance or abatement of such forces. That very same resiliency, moreover, causes the band to embrace the body portion in question in a manner that, ideally, is neither too tight, nor too loose.

Experience has shown that the sizes of wrists or similar body portions vary from person to person within a relatively wide range in dependence on various factors not limited to age, gender or the like. This makes it impossible to offer to the public just a single one-size-fits-all band length. On the other hand, it is at least impractical, if not impossible, to manufacture or keep in stock in sufficient numbers all possible band lengths that may be required at any time by prospective customers.

A way around this has been found, however: retail establishments have started offering to their customers that they would shorten or lengthen the "standard-size" watchbands to fit the customers' wrists comfortably. Unfortunately, the standard expandable bands were not designed with this in mind, so that the length-adjustment service was quite a laborious ordeal involving substantial bending of the sheet metal of which the respective expansion links were made, removal of staple-shaped connecting elements interposed between the adjacent links, and retro deformation of the affected ones of the links remaining after some others have been removed or added.

This, of course, was a less than satisfactory situation not only from the aesthetic viewpoint (it being almost impossible to assure that the double deformation of the affected links will leave behind no discernible marks or traces in all instances), but also from the economic standpoint, (the adjustment operation being rather time consuming and requiring skilled labor and, consequently, being rather expensive).

This has not gone unnoticed in the past, and it has been proposed, for instance in the U.S. Pat. No. 3,237,395 to Bennett, to insert a (non-expandable) extension arrangement between two separate portions of an expandable band. As proposed there, the links in question were provided, on the one hand, with respective abutments located at open ends of recesses, and on the other hand, with spring tongues insertable, in the longitudinal direction of the band, into the aforementioned recesses and engaging, in the opposite direction, behind the above abutments to prevent their retraction, supposedly at all times except in response to deliberate intervention of a human being trying to disassemble the consecutive links.

Yet, it had been established that this type of connection between the consecutive links is not as permanent or stable as it would appear from reading the above patent. Rather, due to the longitudinal orientation of the insertion/abutnent activity, it is possible under some circumstances, such as when the wearer engages in some strenuous activity or conducts rapid movements of the arm in question, for the spring tongues to become dislodged from behind the abutments, upon which there is nothing more preventing the band from falling apart with attendant loss of, or damage to, the wristwatch or similar article.

OBJECTS OF THE INVENTION

Accordingly, it is a general object of the present invention to avoid the disadvantages of the prior art.

More particularly, it is an object of the present invention to provide an expandable band that does not possess the drawbacks of the known bands of this type.

Still another object of the present invention is to devise a band of the type here under consideration which is not only expandable, but also extendable and adjustable, without having to engage in the deformation of any of its constituent components.

It is yet another object of the present invention to design the above band in such a manner as to make the removal or addition of links as easy as possible while simultaneously assuring the integrity of the band under all conditions to which it may be reasonably expected to be exposed while in use.

A concomitant object of the present invention is so to construct the adjustable and extendable band of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an elongated annular element to be worn around a part of the body of a user. This element includes an expandable band including a multitude of expansion links situated adjacent one another as considered in the longitudinal direction of the band and resiliently movable apart and together again in response to application and discontinuance of longitudinally directed external forces to the band, respectively. This multitude of expansion links includes, besides others, two connecting expansion links that are separated from one another to form a gap between themselves.

An extension arrangement for the band is interposed between the connecting expansion links and spans the gap. The extension arrangement includes a plurality of extension links situated next to one another and including two connecting extension links situated next to the connecting expansion links of the band in an assembled condition of the annular element There is further provided means for connecting any desired number of the extension links of the plurality, as well as the connecting links to one another, to give the extension arrangement the length desired for extending the annular element.

According to the present invention, this connecting means includes, on each of the links to be connected, at least one of the following two counterpart formations: a pair of lugs spaced from one another transversely of the annular element and each provided with a through aperture therein, and a sleeve-shaped portion bounding an elongated passage. In further accord with the invention, the connecting means also includes, for each of the two adjacent links to be connected, a resiliently telescopically expandable and retractable elongated connecting pin having a main body received in a respective one of the passages, and two end portions each received in one of the apertures of the associated ones of the lugs in a final condition of use of the annular element.

A particular advantage of the article of manufacture as described so far is that, in view of the fact that any action tending to discontinue the connection between the links in question would have to act transversely of the band and be very pointed (i.e., directed against a very small area and nowhere else), there is, for all intents and purpose, no possibility that the band could accidentally fall apart. Moreover, the transverse arrangement of the components involved in the connecting action makes it possible to minimize the dimension of the links in question that parallels the longitudinal direction of the band, thus making it possible to change the length of the extension arrangement in smallest possible increments.

According to another advantageous aspect of the present invention, each of the connecting expansion elements includes one of the sleeve-shaped portions, and each of the extension elements includes the pair of lugs. In this case, the plurality of extension links further includes a reversing extension link interposed between and permanently secured to selected two of the extension links. In this context, it is particularly advantageous for the reversing extension link to include a pair of caps spaced from one another transversely of the extension arrangement, and means for securing the caps to at least one of each other, and to the sleeve-shaped portions of respective adjacent ones of the extension links.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a developed top plan view of a length-adjustable expandable band embodying the present invention, showing the area thereof that ordinarily faces outwardly when the band is in use;

FIG. 2 is a longitudinal sectional view of the expandable band taken on line 2—2 and rendered on a scale enlarged relative to that of FIG. 1;

FIG. 3 is a cross-sectional view taken on line 3—3 of FIG. 1 and presented on a scale generally corresponding to that of FIG. 2; and FIG. 4 is a partially exploded perspective view of a portion of interest of the band of FIG. 1, indicating how an extension link of the present invention can be added to, or removed from, the band to change the effective length of the latter.

DETAILED DESCRIPTION OF THE PREFERRED EMBODIMENT

Referring now to the drawing in detail, and first to FIG. 1 thereof, it may be seen that the reference numeral 10 has been used therein to identify an article of manufacture that will be referred to throughout this description as a band, and that is particularly suited for use as a watchband. In the latter case, the band 10 itself is unitary and elongated and its longitudinally spaced end portions are secured in a well known manner to the casing of a watch or a similar timepiece. However, it is also within the purview of the present invention to use the principles disclosed here in other applications, such as in decorative bracelets or other adorning or utilitarian articles. Regardless of the application, though, the band 10 forms a closed loop either by itself or in conjunction and/or cooperation with other elements, such as jewelry pieces, not only while actually worn by the user, but at all times; thus, it can be said that the band 10 either constitutes, or is incorporated in, an annular element.

As mentioned before, in order to be able to slide this annular element past regions of relatively greater circumference as it is being moved to or from its position of use, the band 10 has to be longitudinally expandable. To this end, the band 10 includes or consists of a multitude of consecutive expansion links such as those indicated at 11 in the drawing. It is to be mentioned at this juncture that the construction of the band 10 proper as depicted in the drawing, albeit possibly the most popular one, or the prevalent, or even the predominant one on the market today, is not the only one in which or in connection with which the present invention can be used to advantage; therefore, this band construction is illustrated and will be described only to the extent necessary for understanding the present invention.

To complete the picture, though, it is to be brought out that biasing means of a construction irrelevant to the issues considered here is built into the band 10 and more particularly into and/or in between the expansion links 11, urging them towards their relative positions adjacent each other as seen particularly in FIG. 1 of the drawing in which the band 10 is in its filly contracted condition. It may also be worthwhile to point out that FIG. 1 further shows that the respective end portions or, to be more precise, respective end links 11*a* and 11*b* of the band 10 may be secured (in a manner well known to those with even superficial familiarity with wristwatches and their bands and/or straps and hence not disclosed in any detail) not to similar links 11 but rather to respective portions 12*a* and 12*b* of a wristwatch or other casing—actually, the very same one given the fact that FIG. 1 shows the aforementioned annular element in its developed condition in which it extends along the drawing plane.

As also illustrated in FIG. 1 of the drawing, to implement the present invention, the continuity of the series of the successive expansion links 11 is interrupted at a predetermined location (as shown and advantageously, substantially at the longitudinal center of the band 10, but it may also be closer to or even at one or the other of the ends of the band 10 if so desired for any reason). As a result of this interruption, respective expansion links 11*c* and 11*d* which are occasionally referred to herein as "connection" expansion links, rather than being located adjacently and being connected to one another, are located a certain distance or gap apart. Then, an extension arrangement 20 is interposed between these connection expansion links 11*c* and 11*d*, spanning the aforementioned distance.

The extension arrangement 20 consists of a plurality of extension links that are generally identified by the reference numeral 21 and specifically, as the need arises, by the same reference number supplemented by an appropriate alphabetic suffix. Two of these extension links, indicated at 21*c* and 21*d*, are situated next to the expansion links 11*c* and 11*d*, respectively, and are connected to them in a manner yet to be described in an assembled condition of the aforementioned annular element. These extension links 21*c* and 21*d*, like their expansion link counterparts 11*c* and 11*d* and for similar reasons deserve to be denoted by an attribute "connection" and consequently will from time to time be referred to in this manner.

Of course, it is the connection links 11*c* and 21*c* on the one hand, and 11*d* and 21*d* on the other, that are connected to one another in the illustrated embodiment. As a matter of fact, it is to be mentioned that, even though this is not crucial for the present invention, the connecting expansion links 11*c* and 11*d* are so constructed and/or configured that, unlike their predecessors, they are not suited for direct connection to one another (i.e., without the intervention of the extension arrangement 20), at least not without difficulty. On the other hand, they are very well suited for being connected to the respective connection extension links 21*c* and 21*d* by being equipped with certain features akin to those which will be now described in conjunction with the extension links 21. For ease of comparison, such corresponding features of the links 11 and 21 will be denoted by reference numerals differing from one another by a decade. As shown particularly in FIG. 4 of the drawing for the example of the link 21*e*, these features include respective generally sleeve-shaped joining portions 23 (or 13, as the case may be) at one longitudinal end of the respective link 12 (or 11), and their counterparts, namely side lugs 24 and 24' provided with respective through apertures 25 and 25', respectively.

It goes without saying that the joining portions 23 or 13 and their adjacent counterparts 24 and 24' are not constructed to be connected to one another directly; rather, an intermediate member or pin 30 is used in each instance to perform this connecting function. As may be observed especially in FIG. 3 of the drawing, the connecting pin 30 is not that much different, if at all, from those pins that have been traditionally used, and may also be used here, for connecting watch straps or bands to the casing portions 12*a* and 12*b*.

As illustrated, the pin 30 includes an elongated main portion or body 31, and two end portions 32 and 32'. The main body 31 is tubular, i.e., hollow, and as shown, both of the end portions 32 and 32' are partially received in the interior of the tubular main body 31 for sliding relative thereto; however, it ought to be realized that one or the other of the end portions 32 and 32', but not both, could be made immovable relative to the main body 31 without impairing the functionality of the pin 30, either by being received within the main body 31 with a friction or even interference fit, or by being constituted by an integral part of the main body 31 to begin with. The end portion 32 (and, as shown, in a corresponding manner differing just by the use of primes, the end portion 32' as well) includes a stem 33 passing from the interior to the exterior of the main body 31, an enlarged abutment collar 34 adjoining the stem 33 at the exterior of the main body 31, and an insertion end 35 of a diameter smaller than that of the collar 34 following the latter as considered in the outward direction. To complete the picture, it is to be mentioned that the other end of the stem 33 (or 33') is provided with an enlarged guiding collar 36 (or 36') and that a helical expansion spring 37 is interposed between the guiding collars 36 and 36', urging the end portions 32 and 32' apart and hence out of the main body 31.

As a comparison of FIGS. 2 and 3 will reveal, the main body 31 of the respective connecting pin 30 is substantially snugly (i.e., with at most a very small leeway) received in the respective sleeve-shaped portion 23 when the band 10 is in its assembled condition of FIG. 1. In this condition, the collars 34 and 34' abut the respective side lugs 24 and 24', and the insertion ends 35 and 35' are received (once again, rather snugly) in the respective apertures 25 and 25', while the expansion spring 37 is compressed, thus urging the collars 34 and 34' into the aforementioned abutment. This type of connection is very secure in that the connecting action of the pins 30 is directed transversely of the band 10, rather than longitudinally thereof, so that the occasional or even frequent rigors attending the use of the band, whether they include those directed longitudinally, or those caused by the twisting or inside-out inversion of the band 11, and even lateral impacts of the band 11, are incapable of discontinuing the connections provided by the pin action, i.e., of dislodging the insertion ends 35 and 35' from their associated receiving apertures 25 and 25'.

On the other hand, the respective pin connection can rather easily by terminated by a deliberate action on the part of the user (even a relatively unskilled one and/or one without access to special equipment) involving pressing the tip of a pointed object (such as a pin or a needle) against the respective end 35 or 35', causing it to leave the associated aperture 25 or 25' and engage behind the respective lug 24 or 24', after which (or possibly after the same process has been repeated with the other end 35' or 35) the respective end 35 or 35' (or both) can be slid along the associated lug(s) 24 or 24' until it clears it or them.

The reassembly is as easily accomplished by reversing the disassembly process described above, this time, however, using the same or a different object in engagement with the respective abutment collar 34 or 34' for lodging the end 35 or 35' behind the associated lug 24 or 24', then sliding the sleeve-shaped portion 23 between the lugs 24 and 24', followed possibly by slight jiggling, until the ends 35 and 35' become aligned with their associated apertures 25 and 25' and slide into them under the biasing action of the spring 37.

It may be seen when viewing especially FIGS. 2 and 4 in conjunction with one another that not all of the extension links 21 are alike, though, in the illustrated implementation of the present invention. Rather, the extension arrangement 20 includes, besides the regular (substantially identical) links 21, a "special" link indicated by the reference number 21*f* and also called a "reversing" extension link, owing to its function. This reversing link 21*f*, rather than being equipped with the respective connecting counterparts 23 and 24/24', includes two end caps 26 and 26' that are secured to one another and/or to respective adjacent extension links 21 in a permanent, i.e., in a not easily disassemblable, well-known manner, such as by interference fits, via or by means of respective securing pins 27. Of course, the two of the sleeve-shaped portions 23 that adjoin the reversing link 21*f*, one at each of its longitudinal sides as considered lengthwise of the band 11, are made shorter as considered transversely of the band 11 than the other sleeves 23 to make room for the caps 26 and 26'. The presence of the reversing link 21*f* makes it possible for the regular links 21 situated to the opposite longitudinal sides of the link 21*f* to have opposite orientations. One advantageous result of this is that not only the expansion link 11*c* but also, while this is not specifically shown, the expansion link 1*d* nmay be provided with the sleeve-shaped portion 13 to be compatible with the lug-shaped counterparts 24 and 24' of the adjacent link 21*d*.

It should be apparent from the above explanation that the sole purpose of the arrangement 20 is to give the band 10 the desired effective basic (i.e., contracted) length: longer for wearers with thicker, shorter for those with thinner, wrists, to avoid feelings of discomfort on the part of one or the other or both stemming from the band being either too short (and hence exerting too much of a pressure when worn) or too loose. In other words, the extension arrangement 20 does not, nor is it expected to, participate in the expansion activity of the band 10 itself as accomplished by the expansion links 11 and the biasing means interposed between them.

A further important advantage of the construction of the arrangement 20 is that, due to its easy disassembly and assembly, it is possible and easy not only to use it or not (an all or nothing proposition), but also to change its length link-by-link from the minimum of the band length augmented by the reversing link 21*f* and its two adjoining links 21 to a maximum dictated only by the exigencies of the circumstances. In each instance, therefore, the effective length of the annular element 10, 20 can be chosen in small incremental steps to fit the particular user (i.e., to be neither too tight, nor to loose, when worn), while the expansion capability conferred on the annular element 10 by the expandable properties of the band 10 itself lets the wearer take the annular element 10, 20 off or put it on easily by slipping it past relatively larger-circumference regions, such as the hand.

It also should be mentioned that the transversely directed link-connecting action, besides enhancing the security of the connections, brings about the possibility of decreasing the longitudinal dimension of the extension links 21 to a bare minimum; this, in turn, results in reduction in the size of the increments by which the effective length of the annular element 10, 20 can be adjusted, and in concomitant improvement in the "fittability" of the element 10, 20 to the particular user. It is no longer necessary to bend sheet metal, remove and replace staples, and to deform links in order to effect the adjustment.

It will be understood that each of the elements described above, or two or more together, may also find a useful application in other types of constructions differing from the type described above.

While the present invention has been described and illustrated herein as embodied in a specific construction of an expandable and adjustable watchband, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. An elongated annular element to be worn around a part of the body of a user, comprising:

a) an expandable band including a multitude of expansion links situated adjacent one another as considered in the longitudinal direction of the band and resiliently movable apart and together again in response to application and discontinuance of longitudinally directed external forces to said band, respectively, said multitude including two connecting expansion links that are separated from one another to form a gap between themselves;

b) an extension arrangement for said band interposed between said connecting expansion links and spanning said gap, said extension arrangement including a plurality of extension links situated next to one another and including two connecting extension links situated next to said connecting expansion links of said band in an assembled condition of the annular element; and c) means for connecting and removing any desired number of said extension links to one another to give the extension arrangement the length desired for the annular element, including, on each of the extension links to be connected, at least one of a pair of lugs spaced from one another transversely of the annular element, each lug being provided with a through aperture therein, and a sleeve-shaped portion bounding an elongated passage, said connecting means further including, for each two adjacent extension links to be connected, a resiliently telescopically expandable and retractable elongated connecting pin having a main body received in a respective one of said passages, and two end portions each received in one of said apertures of the associated ones of said lugs in a final condition of use of the annular element.

2. The annular element as defined in claim 1, wherein each of said connecting expansion linKs includes one of said sleeve-shaped portions, and each of said connecting extension links includes said pair of lugs; and wherein said plurality of extension links further includes a reversing extension link interposed between and permanently secured to a selected two of said extension links.

3. The annular element as defined in claim 2, wherein said reversing extension link includes a pair of caps spaced from one another transversely of said extension arrangement, and means for securing said caps to at least one of each other and to said sleeve-shaped portions of respective adjacent ones of said extension links.

* * * * *